US012703975B2

(12) United States Patent
O'Keeffe et al.

(10) Patent No.: US 12,703,975 B2
(45) Date of Patent: Aug. 11, 2026

(54) MODULAR WALL APPARATUS AND METHOD OF USE

(71) Applicant: O'KEEFFE'S, INC., Brisbane, CA (US)

(72) Inventors: William F O'Keeffe, Brisbane, CA (US); Peter Reid, Merced, CA (US)

(73) Assignee: O'KEEFFE'S, INC., Brisbane, CA (US)

( * ) Notice: Subject to any disclaimer, the term of this patent is extended or adjusted under 35 U.S.C. 154(b) by 314 days.

(21) Appl. No.: 17/887,205

(22) Filed: Aug. 12, 2022

(65) Prior Publication Data

US 2023/0048127 A1 Feb. 16, 2023

Related U.S. Application Data

(60) Provisional application No. 63/232,487, filed on Aug. 12, 2021.

(51) Int. Cl.
*E04H 17/00* (2006.01)
*E04B 2/74* (2006.01)

(52) U.S. Cl.
CPC ..... *E04B 2/7401* (2013.01); *E04H 17/003* (2013.01)

(58) Field of Classification Search
CPC ..... E04H 17/003; E04H 17/16; E04H 17/18; E04H 17/009; F41H 5/24; F41H 11/00; E01F 13/022; E04B 2/7401
See application file for complete search history.

(56) References Cited

U.S. PATENT DOCUMENTS 3,657,057 A * 4/1972 Shorr ..... B32B 27/365 156/331.7
4,682,457 A 7/1987 Spencer
5,577,710 A * 11/1996 Kirby ..... E04H 17/16 256/11
8,001,880 B2 * 8/2011 White ..... F41H 5/24 404/6
9,670,631 B2 * 6/2017 Ditta ..... E01F 15/083
10,648,780 B2 * 5/2020 Fornusek ..... E04H 17/18
10,767,325 B2 * 9/2020 Humphries ..... E01F 8/0023
(Continued)

FOREIGN PATENT DOCUMENTS

GB 2549332 A 10/2014
KR 20220030489 * 9/2020
(Continued)

OTHER PUBLICATIONS

PCT/US 2022/040225 International Search Report for related application.

*Primary Examiner* — Brian E Glessner
*Assistant Examiner* — Daniel J Kenny
(74) *Attorney, Agent, or Firm* — Bodi Law LLC

(57) ABSTRACT

A modular unit for constructing a barrier, where the modular unit can fully or partially be manufactured in a factory for transport to the location of the barrier, with the modular units having a base and at least a pair of wall panels installed on the base. The modular units are assembled into the barrier by placing the modular units side-by-side along a line or curve on a mounting surface. The modular units are designed with features to prevent climbing or scaling over the barrier and support electronic and power equipment to protect and monitor the protected location.

35 Claims, 5 Drawing Sheets

(56) References Cited

U.S. PATENT DOCUMENTS

| | | | | |
|---|---|---|---|---|
| 10,889,977 | B1 * | 1/2021 | Beck, III | E04H 17/1404 |
| 11,242,694 | B2 * | 2/2022 | Bucarizza | E01F 13/02 |
| 11,753,845 | B2 * | 9/2023 | Potts | E04H 17/185 256/22 |
| 11,788,320 | B2 * | 10/2023 | Bratton | E04H 17/1448 256/21 |
| 2002/0195595 | A1 | 12/2002 | Shepherd | |
| 2007/0278468 | A1 | 12/2007 | Zacarias | |
| 2012/0291619 | A1 * | 11/2012 | White | F41H 5/08 89/937 |
| 2014/0308072 | A1 * | 10/2014 | Sagy | E01F 15/088 404/6 |
| 2019/0136567 | A1 * | 5/2019 | Bucarizza | E01F 9/692 |
| 2021/0363716 | A1 * | 11/2021 | Daniluk | F41H 5/24 |

FOREIGN PATENT DOCUMENTS

| | | | | |
|---|---|---|---|---|
| RU | 2549332 | U1 | 1/1996 | |
| WO | WO-2004085746 | * | 10/2004 | |
| WO | WO-2007039165 | A1 * | 4/2007 | E01F 13/04 |

* cited by examiner

MODULAR WALL APPARATUS AND METHOD OF USE

CROSS-REFERENCES TO RELATED APPLICATIONS

This application claims the benefit of U.S. provisional patent application Ser. No. 63/232,487 filed on Aug. 12, 2021, incorporated herein by reference.

BACKGROUND

The present invention relates to a novel and useful wall apparatus which is durable and is easily assembled in a factory and transportable to an installation location.

Walls are especially useful to isolate structures and provide protection for items enclosed by a wall. Unfortunately, walls can be quite expensive and difficult to assemble. In many cases, wall structures are not durable and require a significant amount of maintenance and repair as time goes on.

There is a need for a wall structure which is easily manufactured in a factory environment in a modular form, which can be transported to the installation location, and then erected and assembled, which provides a durable barrier that may have visibility through the same.

SUMMARY

In accordance with the present application, a novel and useful wall structure is hereinafter described.

The wall structure of the present application includes a partition or unit which may be formed of a generally rectangular sheets of transparent glass placed on a base, which can be manufactured remotely for transport to the installation location. For example, the dimension of the glass wall panel may take the form of a laminated panel having a thickness of at least one half inch and having a dimension of approximately two meters in width and approximately five meters in height. Additional heights can be accommodated, such as up to 18 feet tall or higher to make scaling the barrier difficult. The glass wall panel may also be formed of three plies: one tempered, one annealed, and a polymeric inner layer. Further, the glass wall panel may be placed in a frame or panel.

One aspect of the present application to provide a wall apparatus which is durable and easily assembled along a significant linear platform. Another aspect of the present application is to provide a wall apparatus which permits visibility therethrough to allow persons within the wall to observe objects and events outside the wall. Another aspect of the present application is to provide a wall apparatus which is significantly cheaper to assemble than wall units formed of other material such as metal, wood, and the like. A further aspect of the present application is to provide a wall apparatus that includes electronic amenities such as cameras, seismic detectors, communication units, and the like to allow monitoring of the wall and events in the vicinity of the wall.

Another aspect of the present application is to provide a wall apparatus that includes solar generated electricity to feed electronic and electrical components contained within the wall apparatus. Another aspect of the present application is to provide a wall apparatus which is extremely durable and is able to resist impact objects to a large degree. Another aspect of the present application is to provide a wall apparatus which is adaptable to installation on uneven terrain. A further aspect of the present application is to provide a wall apparatus which is economical to install and may be assembled relatively quickly compared to other wall structures of the prior art. Yet another aspect of the present application is to provide a wall apparatus that is highly resistant to scaling by unauthorized persons. The application possesses a plurality of objects and advantages especially as concerns particular characteristics and features thereof which will become apparent as the specification continues.

Provided are a plurality of example embodiments, including, but not limited to, a modular barrier unit comprising: a first flat wall panel having a first front side and a first back side, said first wall panel also having a perimeter including a first base edge, a first top edge, a first connecting edge, and a first open edge; a second flat wall panel having second front side and a second back side, said second wall panel also having a perimeter including a second base edge, a second top edge, a second connecting edge, and a second open edge; a base having said first base edge of said first wall panel permanently mounted thereon, said base section also having said second base section of said second wall section permanently mounted thereon. The first wall panel is mounted with said first connecting edge adjacent to the second connecting edge of said second wall panel to form a contiguous barrier, and the modular barrier unit is configured such a plurality of said modular barrier units can be arranged at the installation location such that the modular barrier units can be placed sequentially next to each other to form a contiguous barrier by placing the first open edge of one barrier unit adjacent to the second open edge of an adjacent barrier unit along said sequence.

Also provided is a modular barrier unit comprising: a first flat wall panel comprised of laminated glass and having a first front side and a first back side, said first wall panel also having a perimeter including a first base edge, a first top edge, a first connecting edge, and a first open edge, wherein at least a portion of the surface of said first front side is provided with a rough texture to prevent a suction cup from securing to the portion of the first front side; a second flat wall panel comprised of laminated glass and having second front side and a second back side, said second wall panel also having a perimeter including a second base edge, a second top edge, a second connecting edge, and a second open edge, wherein at least a portion of the surface of said second front side is provided with a rough texture to prevent a suction cup from securing to the portion of the second front side; a base comprised of a three of base panels configured in a polygon and forming an interior space within said polygon, wherein said first wall panel is permanently mounted on a first one of said plurality of base panels by connecting the first base edge of the first wall panel to the first one of said plurality of base panels, and wherein said second wall panel is installed on a second one of said plurality of base panels by connecting the second base edge of the second wall panel to the second one of said plurality of base panels, wherein at the third one of said plurality of base panels does not having a wall panel installed thereon, and wherein said first wall panel is mounted on said base with said first connecting edge adjacent to the second connecting edge of said second wall panel to form a contiguous barrier, and further wherein said base is configured to be adjustable for leveling the modular barrier unit when said base is installed on a surface that is uneven; a structural member connecting the first wall panel near or at the first open edge to the second wall panel near or at the second open edge; a barrier device configured to stop or slow a human from climbing over the modular barrier unit, said barrier device being placed on or at the first top edge of the first flat wall panel and the second top edge of the second flat wall panel; a plurality of fittings distributed along a junction comprising the first connecting edge of said first wall panel adjacent to the second connecting edge of said second wall panel, said fittings being configured to permanently connect the first connecting edge of said first wall panel to the adjacent second connecting edge of said second wall panel.

The junction of said first connecting edge and said second connecting edge forming said first wall panel and said second wall panel into a V shape, and at least the base of said modular barrier unit is configured to be manufactured as a unit remotely from an installation location and transported to the installation location as an integrated unit; and said modular barrier unit is configured such a plurality of modular barrier units can be arranged at the installation location such that the modular barrier units can be placed sequentially next to each other to form a contiguous barrier by placing the first open edge of one barrier unit adjacent to the second open edge of an adjacent barrier unit along said sequence.

Still further provided is a method of providing a barrier for protecting a border or a perimeter, with the method comprised of the steps of: manufacturing a plurality of any portion of the above modular barrier units in a factory; transporting the plurality of modular barrier units to the installation location; and arranging the plurality of modular barrier units in a sequence side-by-side along a line or curve to form said barrier.

Still further provided is a method of providing a barrier for protecting a border or a perimeter from entry by humans, said method comprised of the steps of:

manufacturing a plurality of modular barrier units in a factory, each one of said modular barrier units comprising:

a first flat wall panel having a first front side and a first back side, said first wall panel also having a perimeter including a first base edge, a first top edge, a first connecting edge, and a first open edge;

a second flat wall panel having second front side and a second back side, said second wall panel also having a perimeter including a second base edge, a second top edge, a second connecting edge, and a second open edge;

a base having said first base edge of said first wall panel permanently mounted thereon, said base section also having said second base section of said second wall section permanently mounted thereon, wherein said first wall panel is mounted with said first connecting edge adjacent to the second connecting edge of said second wall panel to form a contiguous barrier, wherein said base is configured to be adjustable for leveling the modular barrier unit when said base is installed on a surface that is uneven, a plurality of fittings distributed along a junction comprising the first connecting edge of said first wall panel adjacent to the second connecting edge of said second wall panel, said fittings being configured to permanently connect the first connecting edge of said first wall panel to the adjacent second connecting edge of said second wall panel, wherein wherein the junction of said first connecting edge and said second connecting edge forming said first wall panel and said second wall panel into a V shape (e.g., having a vertex such that said first wall panel forms an angle less than 180° with respect to said second wall panel, and wherein said first front side of said first wall panel is provided on the same side of said junction as the second front side of the second wall panel to form an apex provided at an angle of greater than 180° with respect to the first front side and the second front side);

transporting the plurality of modular barrier units to an installation location; and arranging the plurality of modular barrier units sequentially next to each other on a line or curve on said surface to form a contiguous barrier by arranging, for each barrier unit, the first open edge of one barrier unit adjacent to the second open edge of an adjacent barrier unit along said sequence to form a contiguous barrier, and wherein for each one of the modular barrier units placed on the surface, the base of the respective modular barrier unit is adjusted when necessary to make the modular barrier unit level.

Also provided are additional example embodiments, some, but not all of which, are described hereinbelow in more detail.

BRIEF DESCRIPTION OF THE DRAWINGS

The features and advantages of the example embodiments described herein will become apparent to those skilled in the art to which this disclosure relates upon reading the following description, with reference to the accompanying drawings, in which.

Figure 1:
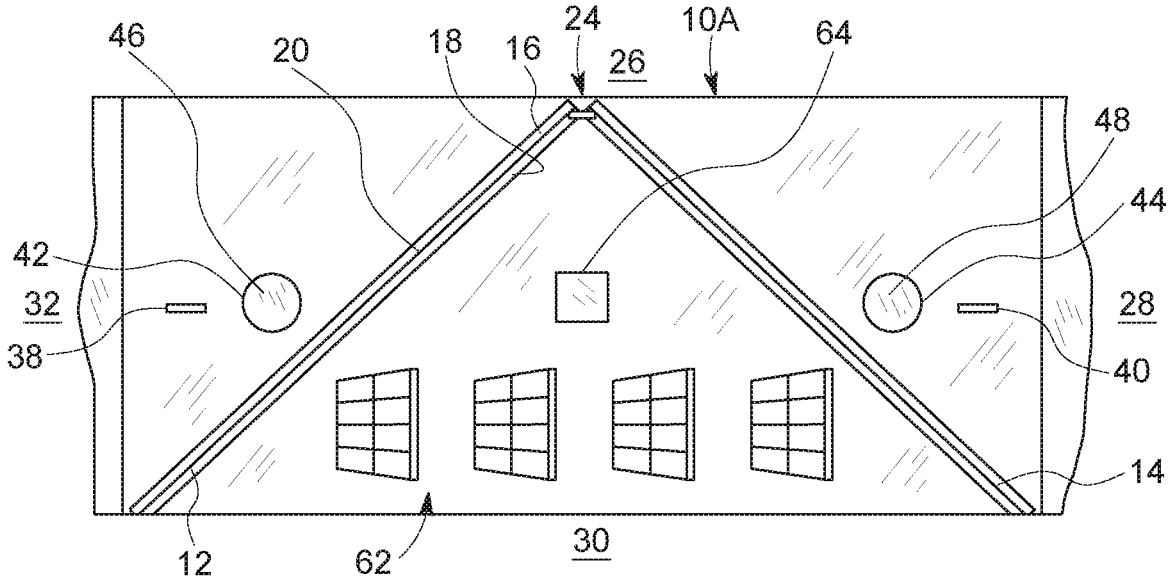
FIG. 1 is a top plan view of a first embodiment of the present application.

For a better understanding of the application, reference is made to the following detailed description of the preferred embodiments thereof which should be referenced to the prior described drawings.

DETAILED DESCRIPTION OF THE EXAMPLE EMBODIMENTS

Various aspects of the present application will evolve from the following detailed description of the preferred embodiments thereof which should be referenced to the prior described drawings. The embodiments of the present application are depicted as a whole by reference character followed by an upper case letter to denote variations thereof.

The wall structure of the present application includes a partition or unit which may be formed of a generally rectangular sheets of flat transparent glass wall panels placed on a base, which can be configured as modular barrier units that can be wholly or partially manufactured remotely for transport to the installation location. For example, each glass wall panel would have a front side and a back side and a perimeter of edges. The dimension of the glass wall panel may take the form of a laminated panel having a thickness of at least one half inch and having a dimension of approximately two meters in width and approximately five meters in height. Additional heights can be accommodated, such as up to 18 feet tall or higher to make scaling the barrier difficult, and wider widths could be used for larger modular units. The glass wall panel may also be formed of three plies: one tempered, one annealed, and a polymeric inner layer. Further, the glass wall panel may be placed in a frame or panel.

Moreover, the glass wall panel may be formed with indicia on its surfaces, roughing on its surfaces, application of a rough surface paint or sheet, and/or include grooves on one or both faces or part of one or both faces near the upper surface to prevent scaling of the same with suction devices. In addition, the upper surface of the glass wall panel may be formed with anti-climb spikes, razors, barbed wire, etc. which can injure and stop a person attempting to scale the panels, which may be electrified as desired to prevent persons from climbing or otherwise moving over the glass wall panel when in place. Two or more glass wall panels of identical structure may be linked together on a base to form a V-shaped or zig-zag arrangement in plan view, with each pair of glass panels forming a vertex having an angle of greater than 180° on one side and less than 180° on the other side. Typically, each modular unit would use one base and two glass panels installed thereon, with the side facing the protected area being provided with less than 180° angle and the apex of the vertex facing the expected source of intruders.

Each V-shaped pair modular unit may be mated with additional V-shaped pair modular units to form a length of wall with a zig-zag pattern. In a set of example embodiments, a modular unit having a base and a pair of glass walls installed thereon is used to form a longer barrier by placing a plurality of modular units side-by-side with minimal gaps between adjacent glass wall panels on a line or on a curve to form a barrier of any desired shape or length.

Note that wall panels could be constructed of materials other than laminated glass, such as steel panels, composites, plastics, ceramics, or laminates of any combination of such materials.

Pairs of wall panels are intended to lie atop a base foundation in the form of a pre-cast base assembly that can form the mobile unit. The pre-cast base assembly could include a front panel or pair of panels and two angularly fastened wall panes mounted on individual base panels. In an example embodiment, a pair of angularly fastened base panels and a front base panel form a generally triangular base assembly when viewed from above, with each one of the angularly fastened base panels having a wall panel mounted thereon, and the front base panel not having a wall panel thereon being for providing structural stability. The front base panel not having a wall panel installed thereon would typically be placed within the protected space.

Base panels having other polygonal shapes are also possible, in particular where larger modules having more than two wall panels installed thereon might be desired. Furthermore, having additional sides can increase the overall stability of the mobile unit. The base panels can form an interior space that can be used to house electronic equipment, for example, and the front base panel may be provided with an access port therein for accessing such components.

Brackets or connectors may be formed on the upper surface of the pre-cast base assembly to interact with the frame or edges of glass wall panels to support the glass wall panels adjacent one another in an orthogonal relationship. Individual glass wall panels may also be connected along common surfaces by brackets in a conventional manner.

Further, the pre-cast base assembly may be formed with an opening (port) on one of the panels to allow for the formation of a utility housing. Integrated leveling tubes and appurtenances may be also used to adapt the pre-cast base assembly foundation to terrain which is uneven. Assembled multiple glass wall panels may also include a number of features such as solar panels to allow the generation of electricity which may support various electronic and electrical components mounted in the utility box or elsewhere on the panel units. For example, seismic sensors, cameras, lights, object detection analytic devices, and communication elements may be positioned to the glass wall panels or to the foundation assembly.

Additionally, chemical fogging apparatuses such as ones emitting pepper spray, may also be included to protect the wall structure from intruders. In any case, the wall structure of the present application via the transparent glass component maintains visibility therethrough to allow observers to view objects and events outside the wall structure when assembled.

Turning to FIGS. 1-4, it may be seen that a first example modular barrier unit embodiment 10A is shown.

Apparatus 10A includes similar wall panel units 12 and 14 which are positioned adjacent one another to form a Vee configuration when viewed from above, as shown in FIG. 1. Exemplary unit 12 is fashioned of a sheet of annealed glass 16, a sheet of tempered glass 18, and with a laminating polymeric interlayer 20 between sheets 16 and 18. Sheets 16 and 18 may possess a thickness of approximately 13 mm. while laminating interlayer 16 may be sized at approximately 1.5 mm.

Units 12 and 14 are connected to one another by a plurality of fittings 22. Plurality of fittings 22 are generally located at the apex 24 of apparatus 10A. For the sake of orientation, the sides of apparatus 10A are designated as south 26, west 28, north 30, and east 32.

Figure 2:
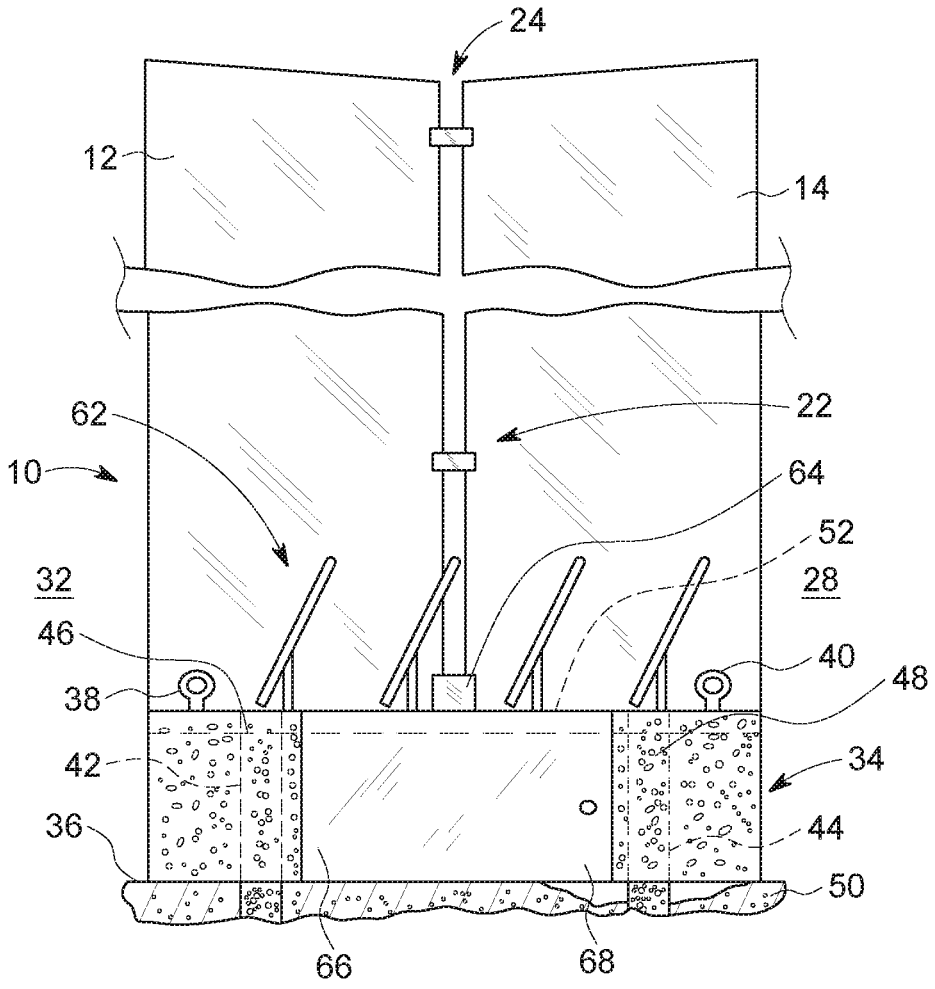
FIG. 2 is a front elevational view of the wall unit of FIG. 1.

For further reference to FIG. 2 it may be observed that apparatus 10 includes a foundation 34 which may be formed or preformed as a concrete structure which lies atop ground surface 36. It should be noted that ground surface 36 may be uneven. Foundation 34 is formed with eye hooks 38 and 40 to allow transportation of the same to a site. In addition, cylindrical tubes 42 and 44 through concrete foundation 34 permit the use of concrete fillers 46 and 48 to further stabilize concrete foundation 34 on ground surface 34. Steel pipes can be provided in use with the tubes/holes to aid in anchoring by driving the pipes into the base and/or ground.

Figure 3:
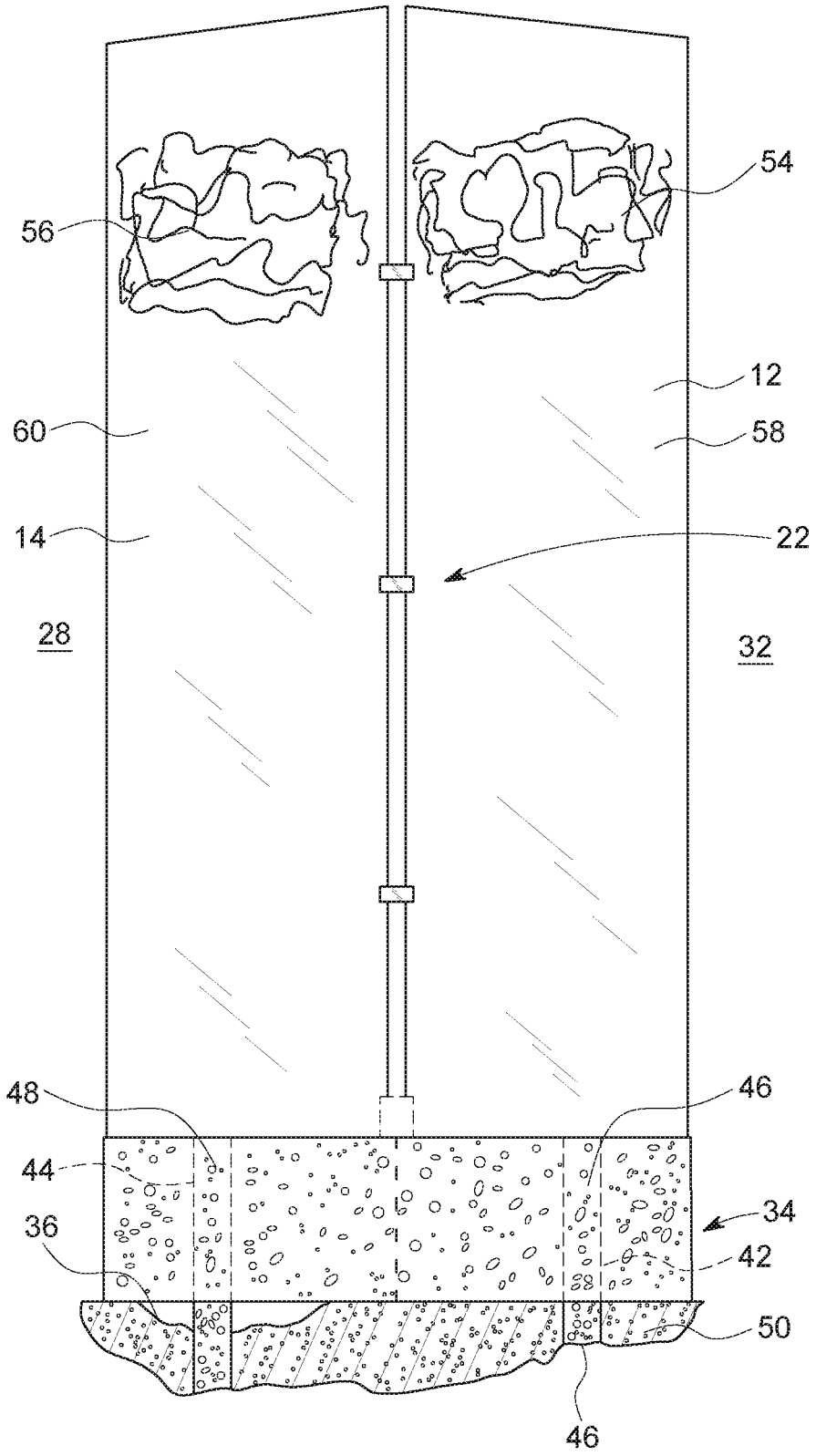
FIG. 3 is a rear elevational view of the wall unit of FIG. 2.
Figure 4:
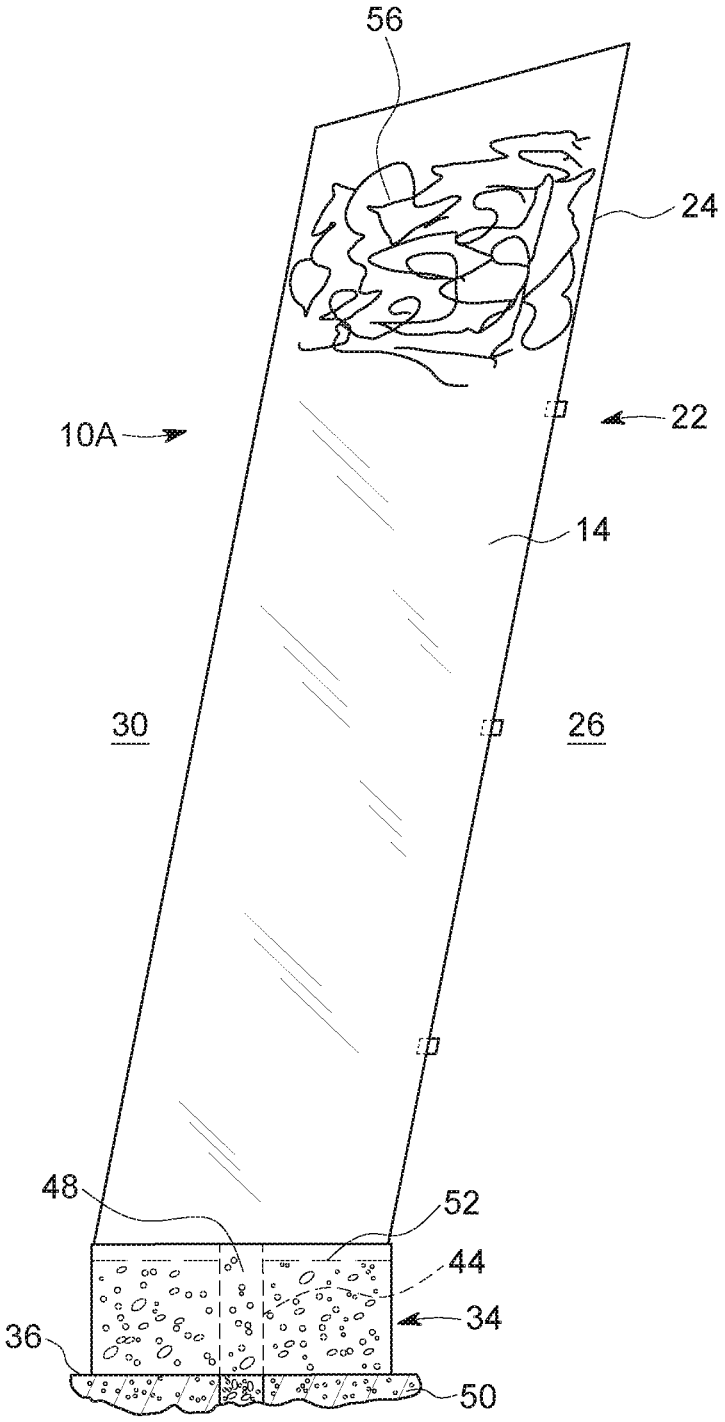
FIG. 4 is a left side elevational view of the wall unit of FIG. 3.

It should be noted that concrete fillers 44 and 46 may extend below ground surface 36 into ground proper 50, FIGS. 2 and 3. Well units 12 and 14 are held to foundation 34 by the use of a groove 52 formed in foundation 34. As depicted in FIG. 4, apparatus 10A may be tilted or canted toward the south side 26, if desired. Alternatively, a vertical arrangement may be provided. As provided above, steel pipes can be driven into the ground to add further stability and to better secure the base.

Also, panels 12 and 14 when viewed from south side 26, would include indicia 54 and 56 on the surfaces 58 and 60 of wall units 12 and 14, respectively. Indicia 54 and 56 may be etched into surfaces 58 and 60 to provide a roughened configuration to prevent the adherence of suction devices, thereto.

Further, the example wall apparatus 10A may be formed with appurtenances such as solar panels 62 and other electrical or electronic devices found in a control box 64.

Control box 64 may be used to monitor solar panels 62. A utility compartment 66 formed in concrete foundation 34 may also be employed to house communication devices, batteries, seismic detection equipment, and the like. Door 68 encloses utility compartment 66.

Figure 5:
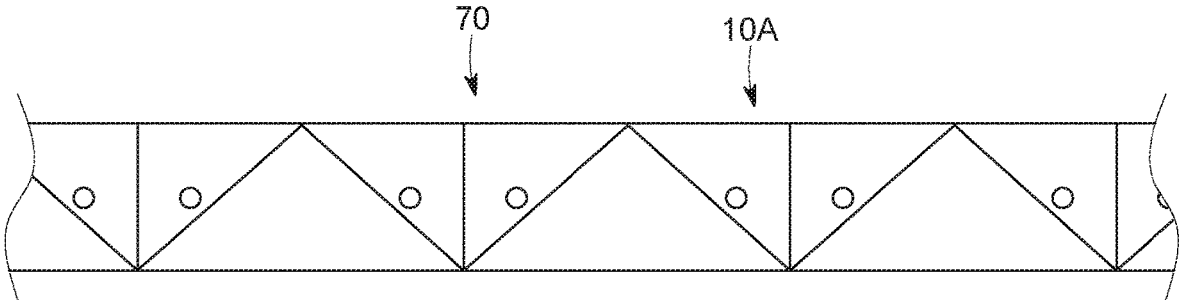
FIG. 5 is a schematic plan view of a multiplicity of wall units extending along a selected dimension using the embodiments shown in FIGS. 1-4 or in FIGS. 5-8.

FIG. 5 depicts a schematic view of a plurality of wall apparatuses 10A aligned end to end to form a wall system 70. Wall system 70 may extent for a substantial distance and form the border of a country, if desired.

Figure 6:
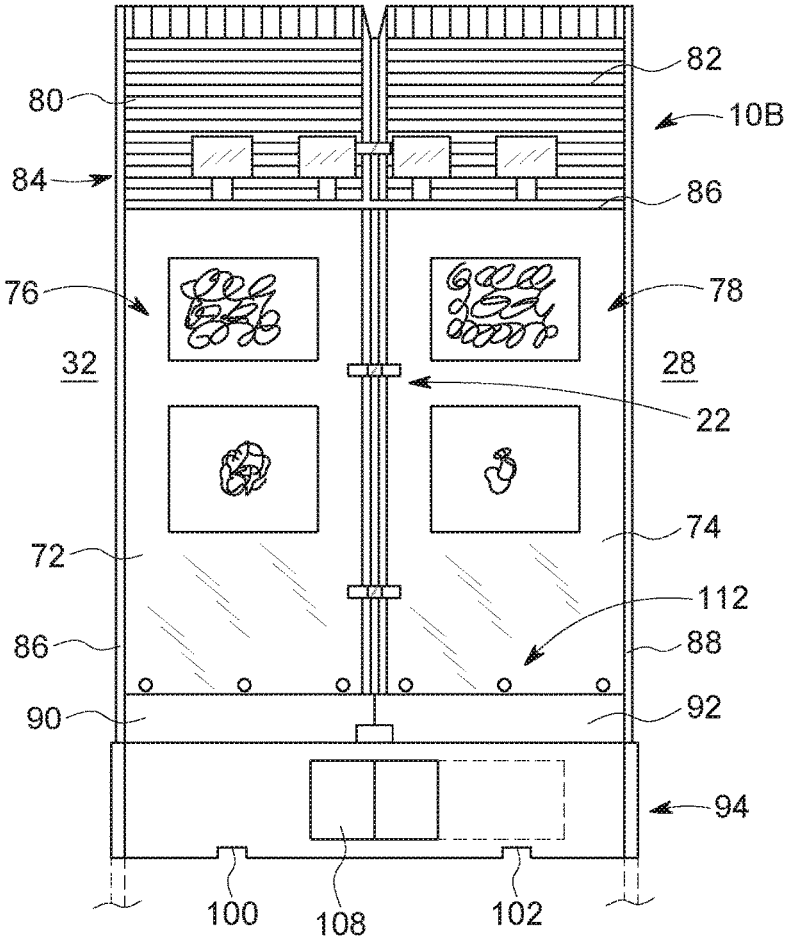
FIG. 6 is a front elevational view of a second embodiment of the present application.
Figure 7:
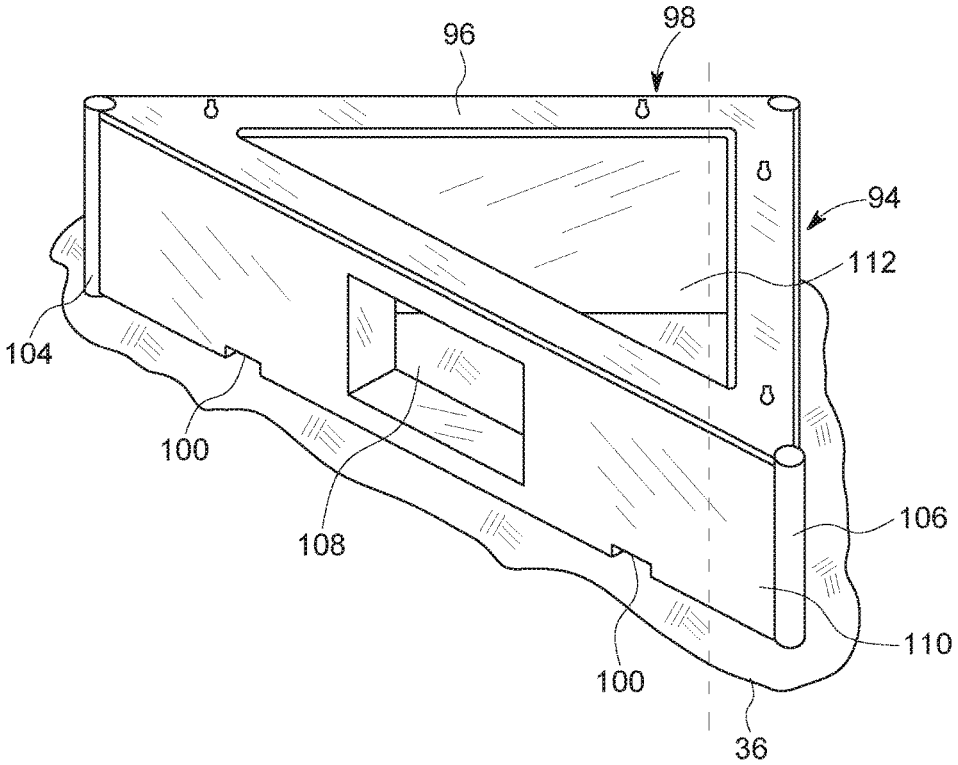
FIG. 7 is a top, front, right side elevational view of the foundation base used in conjunction with the pair of glass wall panels depicted in FIG. 6.
Figure 8:
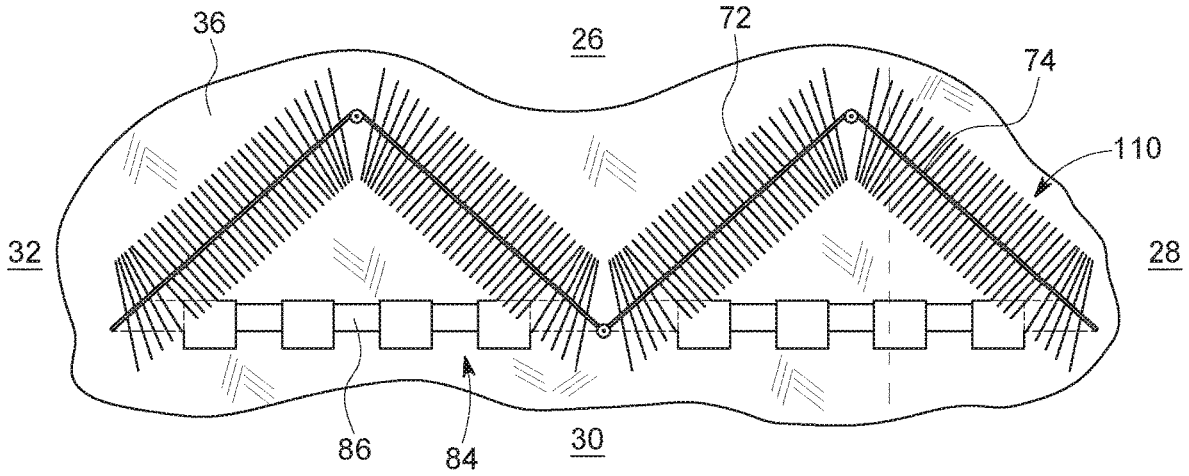
FIG. 8 is a top plan view of a quartet of glass wall panels in place using the glass wall panels of FIG. 6 and foundation units shown in FIG. 7.

Looking now a FIG. 6-8, another example embodiment 10B of the wall apparatus of the present application is shown. Apparatus 10B in its basic form is created by the use of wall panel units 72 and 74. Wall panel units 72 and 74 are again formed from a combination of tempered and annealed transparent glass as well as an intermediate laminating layer, as shown in embodiment 10A with respect to wall panel units 12 and 14.

In addition, wall panel units 72 and 74 include indicia 76 and 78 which may take the form of emblems, flags, caricatures, and the like. Moreover, a multiplicity of grooves 80 and 82 appear on wall units 76 and 78, respectively, and are visible on FIG. 6 although such grooves are formed on the south side 26 of wall panel units 72 and 74 of embodiment 10B. Again, such grooves or etchings prevent the use of suction devices by persons attempting to scale the wall formed by a multiplicity of units of embodiment 10B.

Solar panels 84 mounted on a bar 86 spans wall units 76 and 78. It should also be realized that glass wall units 72 and 74 are mounted on frames 86 and 88. Frames 86 and 88 include bottom portions 90 and 92, respectively. Bar 86 can be configured to provide structural support to the units 72, 74, or be merely provided to securely hold electronic and/or battery components.

Turning now to FIG. 7, it may be seen that a pre-cast base assembly 94 is shown which is used to support wall apparatus of embodiment 10B. Pre-cast base assembly 94 is structured with an upper plate 96 with a plurality of anchors 98. Anchors 98 interact with frame portions 90 and 92 to support wall units 72 and 74 in an upward configuration as shown in FIG. 6.

Pre-cast base unit 94 also includes slots 100 and 102 which permits the positioning of pre-cast base assembly 94 by a forklift. Leveling tubes 104 and 106 allow the positioning of pre-cast base assembly 94 on ground surface 96 and are used in conjunction with levelers (not shown) which allow pre-cast base assembly 94 to lie horizontally along ground surface 36. Additional leveling tubes can also be provided for additional securing and stability (e.g., three-point leveling). Utility housing 108 is formed through surface 110 of pre-cast base assembly and is employed to form a compartment 112 within pre-cast base assembly in order to hold a myriad of items such as batteries, electronics, solar panels, cellular controllers for communication, video analytics, ground sensors, and repelling mechanisms, for example.

Such repelling mechanisms may include the ability to emit pepper spray through plurality of openings 112, FIG. 6. Needless to say, solar panels 84 are capable of powering such devices. Spiked caps 114 lie atop adjacent units, such as units 72 and 74 to prevent scaling of any wall formed by multiplicity of wall units depicted in embodiment 10B of the present application. Such spiked caps may be electrified to further provide security.

Again referring to FIG. 5, a top plan view of a wall formed by a multiplicity of wall apparatuses 10B place side-by-side on a line or curve would form a longer barrier having an overall zig-zag pattern when viewed from above. Wall apparatuses 10A and 10B are easily installed and relatively economical compared to prior art systems. In addition, since a large portion of wall apparatuses 10A and 10B are formed of transparent glass, activities viewed from north side 30 taking place on south side 26 are readily ascertainable.

The example embodiments 10A and 10B can be manufactured, in whole or in part, in a factory as modular units to improve efficiency and quality. The modular units can then be transported to an installation location, such as by truck, plane, helicopter, train, etc., where final installation can be performed.

The bases can be constructed using monolithic concrete precast methods using fixed and or moving molds. Manufacturing facilities for the precast bases can be assembled on-site or strategically located in most cases, much like concrete and asphalt facilities when new highways and bridges are constructed. The bases are modular and so is the ability to manufacture them.

Transportation of the bases is likely via truck and trailer, pre-configured for site installation and to receive whichever wall section is selected. The bases could be staged and distributed throughout the site using the most appropriate method of transportation to include 6×6 boom trucks, tracked vehicles with cranes, tractor-trailer, flatbed vehicles and when required air lifted. Prior to setting each block adjustable legs are deployed within each corner of the base and are ready to be pinned in place to account for uneven terrain.

The glass wall panels could be manufactured in a factory environment and shipped to the site location much like the bases. Precast wall panels would be manufactured similar to the bases utilizing the same precast methods. Steel wall panels can be factory produced or assembled on-site depending on the design. The barrier can be installed in two pieces, the base then the wall panel. The bases would be set and leveled first and then the wall panels would be secured, in some cases the barrier could be completely assembled in a factory or other location remote from the installation site or near but not directly at the installation location and lifted into place with a crane or forklift.

The units are then assembled one next to another with an edge of a wall panel of one unit touching or nearly touching the edge of the wall panel of an adjacent unit. A plurality of the units can be placed along a linear line, or on a curve, in sequence, to form a barrier of any desired shape and length. If desired, the individual wall panels of the adjacent units can be connected together using fittings similar to those used for the individual panels of the separate units. If desired, small gaps between the adjacent wall panels of adjacent units can be filled using a caulk, jambs, braces, or other structural or non-structural gap filling components.

The units can be installed at the desired location with little or no pre-treatment of the ground surface. As described above, the base can have leveling features that allow for leveling the units placed on uneven ground. Alternatively, a special base may be constructed in or on the ground to receive the units, in which case leveling features in the units themselves may not be needed.

Because of the zig-zag arrangement of the wall panels, stability and strength of the finished barrier is greatly improved, preventing the barrier from being toppled or otherwise destroyed. The anti-scaling features prevent human beings from scaling or climbing over the barriers. The surface of the wall panels having the roughing to avoid use of suction cups should be placed facing the expected source of undesired entry, with the opposite sides protecting the protected space(s), although both sides of the wall panels could be so treated to protect from improper entry from either side.

While in the foregoing, embodiments of the application have been set forth in considerable detail for the purposes of making a complete disclosure of the application, it may be apparent to those of skill in the art that numerous changes may be made in such details without departing from the spirit and principles of the application.

It may be apparent that a novel and useful wall apparatus has been heretofore described and is further described hereinbelow and via the drawings and claimed subject matter.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be necessary to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A modular barrier unit comprising:

a first flat wall panel comprising glass forming a continuous panel and having a first front side and a first back side, said first wall panel also having a perimeter including a first base edge, a first top edge, a first connecting edge, and a first open edge;

a second flat wall panel comprising another continuous sheet of glass and having second front side and a second back side, said second wall panel also having a perimeter including a second base edge, a second top edge, a second connecting edge, and a second open edge;

a base having said first base edge of said first wall panel permanently mounted thereon, said base section also having said second base section of said second wall section permanently mounted thereon, wherein said first wall panel is mounted with said first connecting edge adjacent to the second connecting edge of said second wall panel to form a contiguous barrier, wherein said modular barrier unit is configured such that a plurality of said modular barrier units can be arranged at the installation location such that the modular barrier units can be placed sequentially next to each other to form a contiguous barrier by placing the first open edge of one barrier unit adjacent to the second open edge of an adjacent barrier unit along said sequence.

2. The modular barrier unit of claim 1 further comprising a plurality of fittings distributed along an apex comprising the first connecting edge of said first wall panel adjacent to the second connecting edge of said second wall panel, said fittings being configured to permanently connect the first connecting edge of said first wall panel to the adjacent second connecting edge of said second wall panel.

3. The modular barrier unit of claim 1, wherein a junction of said first connecting edge and said second connecting edge forming said first wall panel and said second wall panel into a V shape having a vertex such that said first wall panel forms an angle less than 180° with respect to said second wall panel, and wherein said first front side of said first wall panel is provided on the same side of said junction as the second front side of the second wall panel to form an apex provided at an angle of greater than 180° with respect to the first front side and the second front side.

4. The modular barrier unit of claim 1 further comprising a barrier device placed on or at the first top edge of the first flat wall panel and the second top edge of the second flat wall panel.

5. The modular barrier unit of claim 4, wherein said barrier device is comprised of piercing or cutting components configured to injure a person attempting to scale the modular barrier unit.

6. The modular barrier unit of claim 4, wherein said barrier device is configured to be electrified to electrically shock a person attempting to scale the modular barrier unit.

7. The modular barrier unit of any of claim 1 wherein a surface of one or both of said first front side and/or said second front side is provided with a rough texture to prevent suction cups from securing to the respective front sides.

8. The modular barrier unit of claim 7, wherein said rough texture is provided by placing grooves in the surface of said first front side and/or said second front side.

9. The modular barrier unit of claim 7, wherein said rough texture is provided on only a portion of said first front side placed near the first top portion and/or only a portion of said second front side placed near the second top portion of said second front side.

10. The modular barrier unit of claim 1, wherein said base is comprised of concrete.

11. The modular barrier unit of claim 1, wherein said base is comprised of a plurality of base panels configured in a polygon and forming an interior space within said polygon, wherein said first wall panel is installed on one of said plurality of base panels and wherein said second wall panel is installed on another one of said plurality of base panels with at least one other of said plurality of base panels not having a wall panel installed thereon.

12. The modular barrier unit of claim 11, wherein said base is comprised of three base panels configured into a triangle.

13. The modular barrier unit of claim 1, wherein both said first wall panel and said second wall panel are at least partly transparent.

14. The modular barrier unit of claim 13, wherein said first wall panel and said second wall panel are comprised of a laminated glass.

15. The modular barrier unit of claim 14, wherein said first wall panel and said second wall panel are comprised of the laminated glass including a sheet of annealed glass and a sheet of tempered glass with a laminating polymeric interlayer provided therebetween.

16. The modular barrier unit of claim 1, wherein said base is configured to be adjustable for leveling the modular barrier unit when said base is installed on an uneven surface.

17. The modular barrier unit of claim 1, further comprising a structural member connecting the first wall panel near or at the first open edge to the second wall panel near or at the second open edge.

18. The modular barrier unit of claim 17, wherein said structural member is configured to have one or more electronic and/or battery components mounted thereon.

19. The modular barrier unit of claim 17, further comprising one or more solar batteries mounted on the structural member.

20. The modular barrier unit of any of claim 1, wherein said modular barrier unit is configured to be manufactured as a unit remotely from an installation location and transported to the installation location as an integrated unit.

21. A barrier comprised of a plurality of the modular barrier units of claim 1 formed into a barrier for protecting a border or a perimeter or interior space, wherein a height of each one of the modular barrier units is at least 18 feet tall.

22. A modular barrier unit comprising: a first flat wall panel comprising glass forming a continuous panel and having a first front side and a first back side, said first wall panel also having a perimeter including a first base edge, a first top edge, a first connecting edge, and a first open edge;

a second flat wall panel comprising glass forming a continuous panel and having second front side and a second back side, said second wall panel also having a perimeter including a second base edge, a second top edge, a second connecting edge, and a second open edge;

a base having said first base edge of said first wall panel permanently mounted thereon, said base section also having said second base section of said second wall section permanently mounted thereon, wherein said first wall panel is mounted with said first connecting edge adjacent to the second connecting edge of said second wall panel to form a contiguous barrier, wherein said base is configured to be adjustable for leveling the modular barrier unit when said base is installed on a surface that is uneven; and a plurality of fittings distributed along a junction comprising the first connecting edge of said first wall panel adjacent to the second connecting edge of said second wall panel, said fittings being configured to permanently connect the first connecting edge of said first wall panel to the adjacent second connecting edge of said second wall panel, wherein the junction of said first connecting edge and said second connecting edge forming said first wall panel and said second wall panel into a V shape;

wherein said modular barrier units are configured for transporting the plurality of modular barrier units to an installation location; and wherein said modular barrier units are configured for arranging the plurality of modular barrier units sequentially next to each other on a line or curve on said surface to form a contiguous barrier by arranging, for each barrier unit, the first open edge of one barrier unit adjacent to the second open edge of an adjacent barrier unit along said sequence to form a contiguous barrier.

23. The modular barrier unit of claim 22, wherein said first wall panel and said second wall panel of each of the modular barriers are comprised of a laminated glass.

24. The modular barrier unit of claim 23, wherein said first wall panel and said second wall panel of each of the modular barriers are comprised of the laminated glass including a sheet of annealed glass and a sheet of tempered glass with a laminating polymeric interlayer provided therebetween.

25. The modular barrier unit of claim 22, each one of said modular barrier units further comprising a structural member connecting the first wall panel near or at the first open edge to the second wall panel near or at the second open edge.

26. The modular barrier unit of claim 25, wherein said structural member of each one of the modular barrier units is configured to have one or more electronic and/or battery components mounted thereon.

27. The modular barrier unit of claim 22, wherein each one of said modular barrier units is configured with a lifting structure configured to enable each one of said modular barrier units to be lifted for transportation.

28. The modular barrier unit of claim 22, wherein said base is comprised of a plurality of base panels configured in a polygon and forming an interior space within said polygon, wherein said first wall panel is installed on one of said plurality of base panels and wherein said second wall panel is installed on another one of said plurality of base panels with at least one other of said plurality of base panels not having a wall panel installed thereon.

29. A modular barrier unit comprising:

a first flat wall panel comprised of laminated glass and having a first front side and a first back side, said first wall panel also having a perimeter including a first base edge, a first top edge, a first connecting edge, and a first open edge, wherein at least a portion of the surface of said first front side is provided with a rough texture to prevent a suction cup from securing to the portion of the first front side;

a second flat wall panel comprised of laminated glass and having second front side and a second back side, said second wall panel also having a perimeter including a second base edge, a second top edge, a second connecting edge, and a second open edge, wherein at least a portion of the surface of said second front side is provided with a rough texture to prevent a suction cup from securing to the portion of the second front side;

a base comprised of three base panels configured in a polygon and forming an interior space within said polygon, wherein said first wall panel is permanently mounted on a first one of said plurality of base panels by connecting the first base edge of the first wall panel to the first one of said plurality of base panels, and wherein said second wall panel is installed on a second one of said plurality of base panels by connecting the second base edge of the second wall panel to the second one of said plurality of base panels, wherein the third one of said plurality of base panels does not have a wall panel installed thereon, and wherein said first wall panel is mounted on said base with said first connecting edge adjacent to the second connecting edge of said second wall panel to form a contiguous barrier, and further wherein said base is configured to be adjustable for leveling the modular barrier unit when said base is installed on a surface that is uneven;

a structural member connecting the first wall panel near or at the first open edge to the second wall panel near or at the second open edge;

a barrier device configured to stop or slow a human from climbing over the modular barrier unit, said barrier device being placed on or at the first top edge of the first flat wall panel and the second top edge of the second flat wall panel;

a plurality of fittings distributed along a junction comprising the first connecting edge of said first wall panel adjacent to the second connecting edge of said second wall panel, said fittings being configured to permanently connect the first connecting edge of said first wall panel to the adjacent second connecting edge of said second wall panel, wherein the junction of said first connecting edge and said second connecting edge forming said first wall panel and said second wall panel into a V shape, and wherein at least the base of said modular barrier unit is configured to be manufactured as a unit remotely from an installation location and transported to the installation location as an integrated unit; and wherein said modular barrier unit is configured such that a plurality of modular barrier units can be arranged at the installation location such that the modular barrier units can be placed sequentially next to each other to form a contiguous barrier by placing the first open edge of one barrier unit adjacent to the second open edge of an adjacent barrier unit along said sequence.

30. The modular barrier unit of claim 29, wherein said first wall panel and said second wall panel are comprised of the laminated glass including a sheet of annealed glass and a sheet of tempered glass with a laminating polymeric interlayer provided therebetween.

31. The modular barrier unit of claim 29, wherein said barrier device is comprised of piercing or cutting components configured to injure a person attempting to scale the modular barrier unit.

32. The modular barrier unit of claim 29, wherein said barrier device is configured to be electrified to electrically shock a person attempting to scale the modular barrier unit.

33. The modular barrier unit of claim 29, wherein said rough texture is provided by placing grooves in the surface of said first front side and said second front side.

34. A barrier comprised of a plurality of the modular barrier units of claim 29 formed into a wall for protecting a border or a perimeter, wherein a height of each one of the modular barrier units is at least 18 feet tall.

35. The modular barrier unit of claim 29, wherein the entire modular barrier unit is configured to be manufactured in a factory as a unit remotely from an installation location and further configured to be transported to the installation location as an integrated unit.

* * * * *